US005740611A

United States Patent [19]

Schloss

[11] Patent Number: 5,740,611

[45] Date of Patent: Apr. 21, 1998

[54] GROOMING DEVICE

[76] Inventor: Caroline M. Schloss, 1925 Wilroy Rd., Suffolk, Va. 23434-2307

[21] Appl. No.: 677,329

[22] Filed: Jul. 2, 1996

Related U.S. Application Data

[63] Continuation-in-part of Ser. No. 351,934, Dec. 8, 1994, abandoned.

[51] Int. Cl.[6] ..... B25B 9/00

[52] U.S. Cl. ..... 30/29.5; 30/131; 30/29; 606/133; 606/211; 294/99.2

[58] Field of Search ..... 30/28, 29, 29.5, 30/131, 134, 143, 152, 153, 155, 175, 176, 178, 179, 253; 606/133, 210, 211; 294/99.1, 99.2; D28/55

[56] References Cited

U.S. PATENT DOCUMENTS

| | | | |
|---|---|---|---|
| D. 214,225 | 5/1969 | Grande | D28/55 |
| 1,610,925 | 12/1926 | Bryan | 606/211 |
| 2,254,738 | 9/1941 | Gamache | 30/175 |
| 2,413,998 | 1/1947 | Scott | 606/133 |
| 2,998,649 | 9/1961 | Miller et al. | 30/131 |
| 2,999,506 | 9/1961 | Hunt | 30/29 |
| 3,054,182 | 9/1962 | Whitton, Jr. | 30/179 |
| 4,478,221 | 10/1984 | Heiss | 606/210 |

*Primary Examiner*—Hwei-Siu Payer

*Attorney, Agent, or Firm*—Dickstein Shapiro Morin & Oshinksy LLP

[57] ABSTRACT

A grooming device including a stem, a first and a second arm extending from one end of the stem, the first arm having a first flat surface and the second arm having a second flat surface arranged substantially parallel to the first flat surface. An angled surface is located adjacent to the first flat surface and a blade is located adjacent to the second flat surface such that when a force is exerted on the first and second arms, the first and second flat surfaces come in contact with each other and the blade slides past the angled surface. A housing case member in the general shape of a rectangle and having an opening, configured such that the stem and first and second arm fit inside the opening, encases the tweezer-scissor member when the grooming device is in the folded position. The tweezer-scissor member rotates around a pin which affixes the tweezer-scissor member to the housing case member.

12 Claims, 2 Drawing Sheets

GROOMING DEVICE

This application is a continuation-in-part of application Ser. No. 08/351,934, filed Dec. 8, 1994, now abandoned, the entire disclosure of which is incorporated herein by reference.

BACKGROUND OF THE INVENTION

1. Field of Invention

The present invention relates to tweezers and scissors having a retractable housing case.

2. Description of the Art

To groom or remove unwanted hair, particularly facial hair, it is common in the art to use conventional tweezers or some type of scissors. For example, grip scissors and conventional tweezers are effective in removing unwanted hair from eye lashes, eye brows, mustaches and difficult to reach locations such as nostrils and ears. In addition, conventional tweezers are useful to groom eye lashes, eyebrows, mustaches and other hair. Tweezers differ from scissors in that tweezers pull hair out of the skin, removing the entire hair follicle, whereas scissors cut the hair follicle and leave the hair root behind.

In grooming, one often uses conventional tweezers and scissors in conjunction with each other, alternating between devices in order to obtain the desired look. This alternating between tools is cumbersome, slow and inconvenient. Accordingly, there is a need in the art for a device integrating both tweezers and scissors into a single grooming tool.

SUMMARY OF THE INVENTION

The present invention alleviates the disadvantages of using conventional tools to groom and remove hair by providing a device that includes both tweezers and scissors in a single unit.

It is an objective of the present invention to provide a low cost device integrating tweezers and scissors that can cut or pull hair and that is convenient, compact, safe, and easy to use and clean.

It is a further objective to provide a simple integral tweezer-scissor device whose assembly is both easy and economical.

It is an objective of this invention to provide an integral tweezer-scissor device with the foregoing advantages that includes a housing case which improves stability, handling and control of the tweezer-scissor unit during operation.

It is another objective of this invention to provide grooming device including a stem, a first and a second arm extending from one end of the stem, the first arm having a first flat surface and the second arm having a second flat surface arranged substantially parallel to the first flat surface, an angled surface located adjacent to the first flat surface, and a blade located adjacent to the second flat surface such that when a force is exerted on the first and second arms, the first and second flat surfaces come in contact with each other and the blade slides past the angled surface.

It is an objective of this invention to provide an integral tweezer-scissor device with the foregoing advantages that includes a housing case which encloses the tweezer-scissor member in a folded position when the device is not in use.

It is an additional objective of this invention to provide an integral tweezer-scissor device with the foregoing advantages and including a housing case that contains a groove which locks the tweezer-scissor member in place while in the folded position.

It is a further objective of this invention to provide an integral tweezer-scissor device with the foregoing advantages and including a housing case that contains a recess engageable by the user to facilitate extraction of the tweezer-scissor member from the housing case.

Other objects, features and advantages of the present invention will become apparent from the following detailed description and drawings of the preferred embodiments of the present invention.

Briefly described, the invention comprises a grooming device including a stem, a first and a second arm extending from one end of the stem, the first arm having a first flat surface and the second arm having a second flat surface arranged substantially parallel to the first flat surface. An angled surface is located adjacent to the first flat surface and a blade is located adjacent to the second flat surface such that when a force is exerted on the first and second arms, the first and second flat surfaces come in contact with each other and the blade slides past the angled surface.

DETAILED DESCRIPTION OF THE PREFERRED EMBODIMENTS

Figure 1:
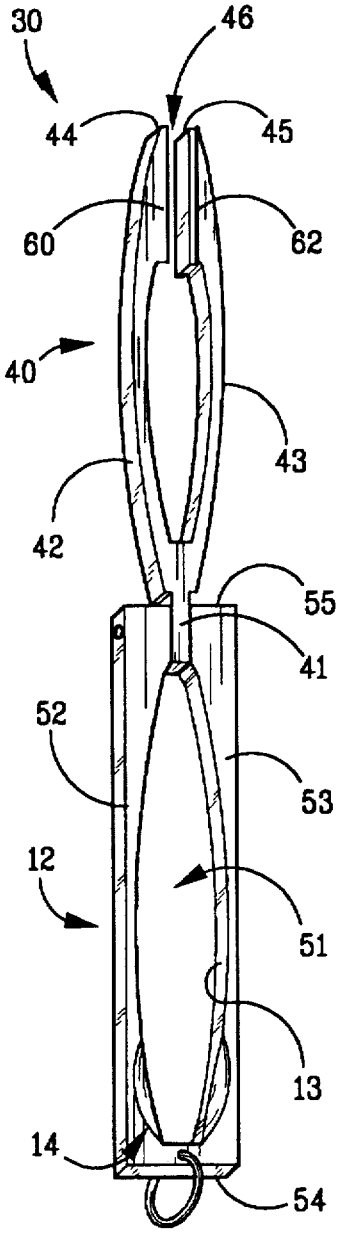
FIG. 1 is perspective side view of a preferred embodiment of an integral tweezer-scissor device extracted from its housing case in its ready-to-use position.
Figure 3:
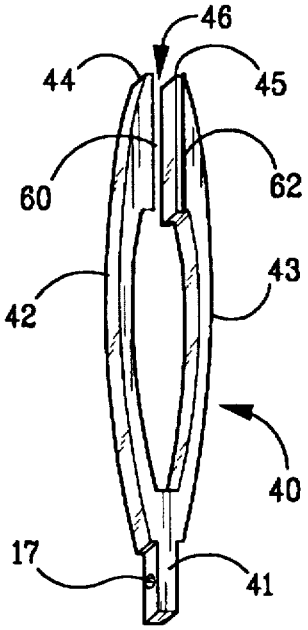
FIG. 3 is a perspective side view of the integral tweezer-scissor member of FIG. 1.

Refer now to FIG. 1 showing a preferred embodiment of a grooming tool, generally designated by reference numeral 30, according to the present invention, in its ready-to-use position. The tool 30 includes an integral tweezer-scissor member 40 and a housing case member 12. As seen in FIGS. 1 and 3, the tweezer-scissor member 40 includes a single stem 41 and two arms 42, 43 extending from the stem 41. From each arm 42, 43 extends a first 60 and second end 62, positioned such that a space 46 lies between them. The ends 60, 62 terminate in first 44 and second 45 tips, respectively.

Figure 2:
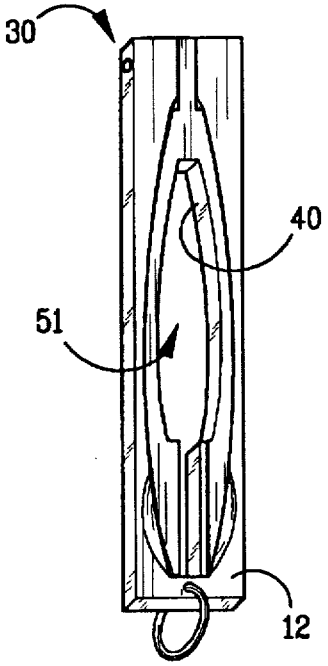
FIG. 2 is a perspective side view of a preferred embodiment of the device of FIG. 1 in its folded position.
Figure 4:
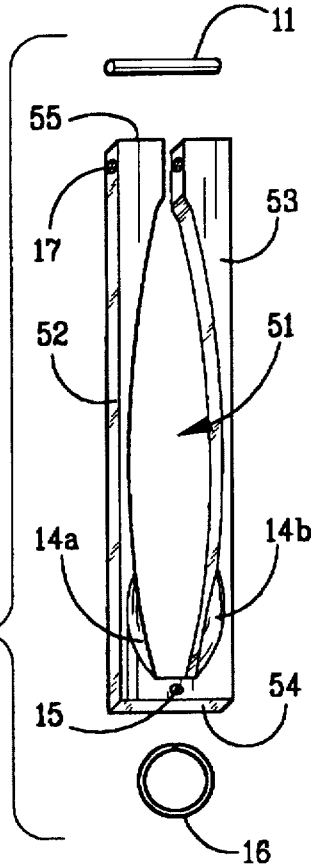
FIG. 4 is a perspective exploded view of the housing case of FIG. 1.

FIGS. 1 and 4 show that the housing case member 12 is rectangular having a first long side 52 parallel to a second long side 53, and a first short side 54 parallel to a second short side 55. The long sides 52, 53 are perpendicular to the short sides 54, 55 and the sides 52–55 collectively define an opening 51. The opening 51 is sized to accommodate the tweezer-scissor member 40 such that the tweezer-scissor member 40 fits snugly inside the opening 51 when the tweezer-scissor device 30 is in its folded position, as shown in FIG. 2. When the tweezer-scissor device 30 is in the folded position, it may be locked inside the housing case member 12 by a groove 13 formed in the inside surface of one of the long sides 52, 53.

A recess 14, which is sized to accommodate the finger or thumb of a user, may be formed in the long sides 52, 53 of the housing case member 12 (FIG. 1). By inserting a finger or thumb into the recess 14 the user can extract the tweezer-scissor member 40 from the housing case member 12 in order to put the device into its ready-to-use position shown in FIG. 1. In the embodiment of FIGS. 1–4, the recess 14 includes crescent shaped portions 14*a*, 14*b* that are concave with respect to the opening 51.

The first short side 54 may include a ring hole 15 (FIG. 4) through which runs a ring 16. The ring 16 is used to carry the tweezer-scissor device 30. The tweezer-scissor device 30 also includes a pin 11 inserted in a pin hole 17, located in both the stem 41 (FIG. 3) and long sides 52, 53 (FIG. 4). This pin 11 fastens the tweezer-scissor member 40 to the housing case member 12, but allows the members 40, 12 to pivot around the pin 11.

Figure 6:
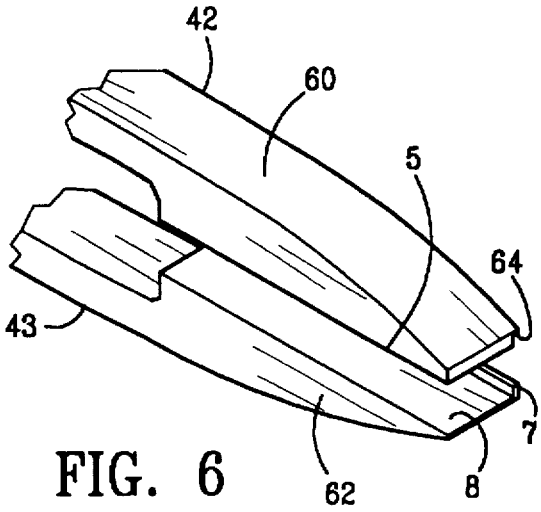
FIG. 6 is a perspective second side view of the tweezer-scissor member of FIG. 5.
Figure 5:
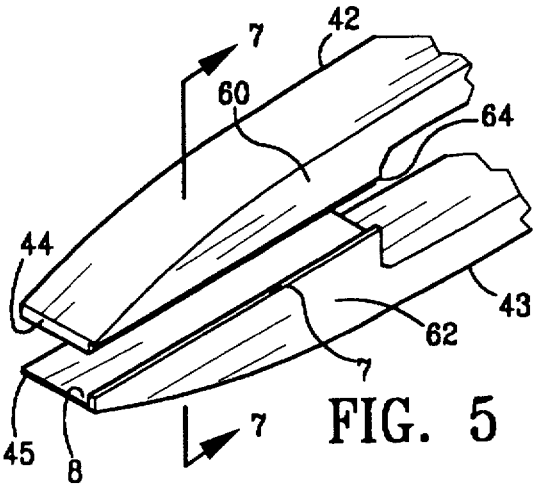
FIG. 5 is a perspective first side view of the end of the tweezer-scissor member of FIG. 1.
Figure 7:
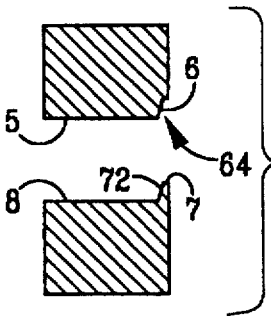
FIG. 7 is a cross-sectional view taken along line 7—7 of FIG. 5.

Refer now to FIGS. 5–7 showing the ends 60, 62 of the tweezer-scissor member 40. A receiving recess 64 is formed in the first end 60 and extends longitudinally along the length of the first end 60. The receiving recess 64, is bounded by an angled surface 6, shown in FIG. 7. The angled surface 6 abuts a first flat surface 5 which also extends longitudinally along the length of the first end 60.

The second end 62 includes a second flat surface 8 that is parallel to the first flat surface 5 and extends longitudinally along the length of the second end 62. A blade 7 extends from the second flat surface 8 and is sized to fit within the receiving recess 64. The blade 7 includes a cutting edge 72 that slides past the angled surface 6 when the first 42 and second 43 arms are urged towards each other (see FIG. 10).

To use the device, a user pivots the tweezer-scissor member 40 about the pin 11 from the folded position (FIG. 2) by pushing the tweezer-scissor member 40 out of the housing case member 12 with a finger placed in the recess 14. In the ready-to-use position (FIG. 1), the housing case member 12 adds to the balance and stability of the device 30. In operation, the user exerts a compressive force on both the first 42 and second arms 43 to bring the first 60 and second ends 62 closer to one another and to reduce the size of the space 46 between them 60, 62.

Figure 8:
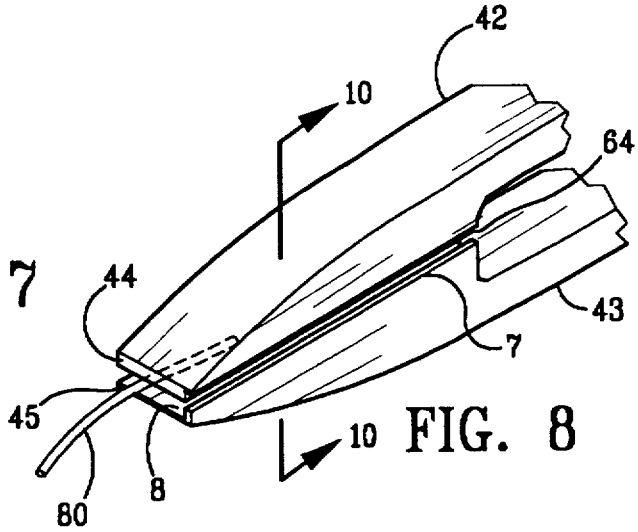
FIG. 8 is a perspective view of the tweezer-scissor member of FIG. 5 engaged in the tweezing function.
Figure 10:
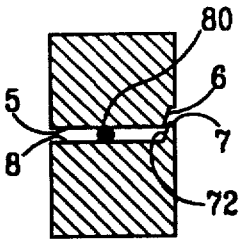
FIG. 10 is a cross-sectional view taken along line 10—10 of FIG. 8.

To tweeze or pull hair out of the skin, the user positions the tweezer-scissor member as shown in FIGS. 8 and 10. A strand of hair 80 is located within the space 46 and extends from the tips 44, 45 of the device. The user then presses the arms 42, 43 together until the first 5 and second flat surfaces 8 come into contact with each other and trap the hair strand 80. Then, the user pulls the hair strand 80 from the skin, to remove the entire hair follicle. The strand 80 is not cut because it does not contact the blade 7, the cutting edge 72, or the angled surface 6 of the recess 64 (see FIG. 10).

Figure 9:
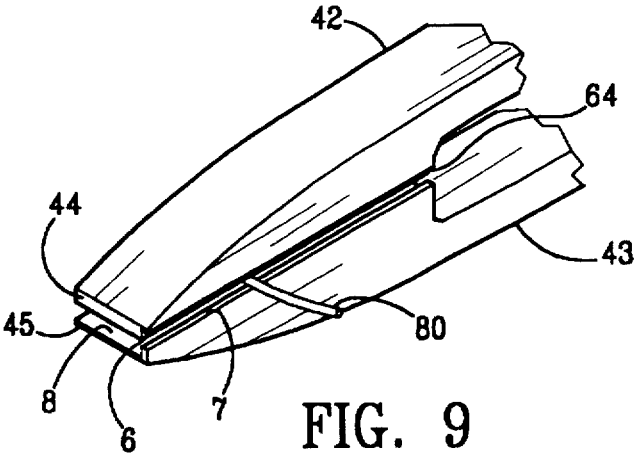
FIG. 9 is a perspective view of the tweezer-scissor member of FIG. 5 engaged in the cutting function.

To cut hair, the user positions the tweezer-scissor member as shown in FIG. 9 such that a hair strand 80 is located within the space 46, but between the blade 7 and the recess 64. The user then presses the arms 42, 43 together until the blade 7 slides over the angled surface 6, catching the hair strand 80 and producing a cutting force to cut the hair 80. During the cutting operation, the hair root is left embedded within the skin.

The grooming device of FIGS. 1–10 is an improvement over the devices of the prior art because it enables the user to perform both cutting and tweezing functions with a single tool. The ability to accomplish both functions alleviates the need to change tools during the grooming process. Furthermore, a single tool is more convenient because it is easier to transport than multiple devices. The ability of the present invention to be folded into a compact carrying case also adds to the device's convenience.

The above description and drawings are only illustrative of preferred embodiments of the present invention, and are not intended to limit the present invention thereto. Any modification of the present invention which comes within the spirit and scope of the following claims is to be considered part of the present invention.

What is claimed is:

1. A grooming tool comprising:

a tweezer-scissor member having a single stem, a first arm and a second arm extending from one end of the single stem, the first and second arms each having a first and second end surface respectively, a first flat 25 surface and a second flat surface integral with the first and second end surface respectively, a blade extending from the second arm adjacent to the second flat surface, the first arm having an angled surface adjacent the first flat surface, wherein the first and second flat surfaces come in contact with each other when a force is exerted on the first and second arms and wherein the blade slides past the angled surface when a force is exerted on the first and second arms thereby performing a cutting function; and a housing case member having a first long side and a second long side, a first short side and second short side, and an opening, a pin affixing the stem to the housing case member, the opening configured such that the stem and first and second arms fit inside the opening.

2. The grooming tool of claim 1 wherein the first and second long sides and the first and second short sides form a rectangle.

3. The grooming tool of claim 1 wherein the first and second long sides have a pair of recesses for facilitating the extraction of the tweezer-scissor member from the housing case member.

4. The grooming tool of claim 3 wherein the pair of recesses are crescent shaped.

5. A grooming device comprising:

a stem;

a first arm and a second arm extending from one end of the stem, the first arm having a first flat surface and the second arm having a second flat surface arranged substantially parallel to the first flat surface;

an angled surface located adjacent to the first flat surface;

a blade located adjacent to the second flat surface; such that when a force is exerted on the first and second arms, the first and second flat surfaces come in contact with each other and the blade slides past the angled surface.

6. The grooming device of claim 5 further comprising:

a housing case member sized to receive the stem, the first arm and the second arm; and a pin for affixing the stem to the housing case member.

7. The grooming device of claim 6 wherein the housing case member is rectangular.

8. The grooming device of claim 6 wherein the housing case member includes a groove for locking at least one of the first and second arms into the housing case member.

9. The grooming device of claim 6 wherein the housing case member includes a recess engageable by a finger of a user to push the first and second arms out of the housing case member.

10. The grooming device of claim 9 wherein the recess includes a first groove and a second groove curved such that the first and second grooves are concave with respect to each other.

11. The grooming device of claim 5 wherein the angled surface defines a wall of a recess formed in the first arm and sized to accommodate the blade.

12. A method of grooming hair using a hair cutting device, wherein the device includes: (a) a tool with two arms each having ends and each end having a flat surface and a cutting surface wherein the ends do not touch each other in a static position; and (b) a housing case with a generally rectangular shape with an opening having a configuration mirroring that of the tool, the method comprising the steps of:

compressing the two arms together such that the flat surfaces of said arms come into contact with each other and trap a strand of hair;

holding the two arms together and pulling on the strand of hair;

releasing the two arms, allowing the flat surfaces to disengage each other;

reorienting the device such that a strand of hair is located between the cutting surfaces;

pressing the two arms together such that the cutting surfaces of said arms come into contact with each other and cut a strand of hair;

releasing pressure on the two arms, allowing the cutting surface to return to the static position.

* * * * *